US009605382B2

(12) United States Patent
Virtanen

(10) Patent No.: US 9,605,382 B2
(45) Date of Patent: Mar. 28, 2017

(54) PROCESS FOR PRODUCTION OF PAPER OR BOARD

(71) Applicant: KEMIRA OYJ, Helsinki (FI)

(72) Inventor: Mikko Virtanen, Helsinki (FI)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 14/774,906

(22) PCT Filed: Mar. 7, 2014

(86) PCT No.: PCT/FI2014/050173

§ 371 (c)(1),
(2) Date: Sep. 11, 2015

(87) PCT Pub. No.: WO2014/154937

PCT Pub. Date: Oct. 2, 2014

(65) Prior Publication Data

US 2016/0032530 A1 Feb. 4, 2016

(30) Foreign Application Priority Data

Mar. 26, 2013 (FI) ..... 20135292

(51) Int. Cl.

| | |
|---|---|
| ***D21H 17/28*** | (2006.01) |
| ***D21H 17/63*** | (2006.01) |
| ***D21H 17/69*** | (2006.01) |
| ***D21H 21/10*** | (2006.01) |
| ***D21H 21/18*** | (2006.01) |
| ***D21H 17/37*** | (2006.01) |
| ***D21H 17/68*** | (2006.01) |

(52) U.S. Cl.

CPC ..... *D21H 17/28* (2013.01); *D21H 17/375* (2013.01); *D21H 17/63* (2013.01); *D21H 17/68* (2013.01); *D21H 17/69* (2013.01); *D21H 21/10* (2013.01); *D21H 21/18* (2013.01)

(58) Field of Classification Search

CPC ..... D21H 17/28; D21H 17/68; D21H 17/37

USPC ..... 162/164.6, 176

See application file for complete search history.

(56) References Cited

U.S. PATENT DOCUMENTS

| | | | | |
|---|---|---|---|---|
| 9,157,189 | B2 * | 10/2015 | Heiskanen | D21H 11/18 |
| 2013/0180680 | A1 * | 7/2013 | Axrup | D21H 17/24 162/177 |

FOREIGN PATENT DOCUMENTS

| | | |
|---|---|---|
| WO | 9823815 | 6/1998 |
| WO | 2005097678 | 10/2005 |
| WO | 2011068457 | 6/2011 |
| WO | 2012039668 | 3/2012 |
| WO | 2013038061 | 3/2013 |

OTHER PUBLICATIONS

National Board of Patents and Registration of Finland. Search report dated Dec. 12, 2013.

Hubbe M. Mini-Encyclopedia of Papermaking Wt-End Chemistry; Norht Carolina State Univ., US. published Feb. 12, 2013, chapters Bentonite adn 'Micro-particles' [retrieved Dec. 2, 2013] from internet addresses: http;//4.ncsu.edu/~hubbe/MinEncy.htm, http;//4.ncsu.edu/~hubbe/MCRO.htm, and http;//4.ncsu.edu/~hubbe/BENT.htm.

Ahola, S. et al. Cellulose nanofibril-adsorption with poly(amideamine)epichlorohydrin studied by QCM-D and application as a paper strength additive. Cellulose 2008, vol. 15, pp. 303-314, DOI:10, 1007/s10570-007-9167-3.

* cited by examiner

*Primary Examiner* — Mark Halpern
(74) *Attorney, Agent, or Firm* — Berggren Inc.

(57) ABSTRACT

The invention relates to a process for production of paper or board comprising providing a stock comprising cellulose fibers, adding a mixture comprising microfibrillated cellulose and a strength additive to the stock, adding a microparticle to the stock after the addition of said mixture, dewatering the stock on a wire to form a web, and drying the web.

19 Claims, No Drawings

PROCESS FOR PRODUCTION OF PAPER OR BOARD

This application is a national application of PCT-application PCT/FI2014/0505173, filed on Mar. 7, 2014, which claims priority of the Finnish national application number FI20135292 filed on Mar. 26, 2013, both of which are incorporated herein by reference.

FIELD OF THE INVENTION

The present invention relates to a process for production of paper or board.

BACKGROUND ART

There are continuous attempts in the field of paper industry to find ways of reducing costs when producing paper or board without worsening properties, such as strength, of the paper or board. The costs have been reduced for example by increasing filler content of a paper or board. When increasing the filler content, the amount of fibers in the paper or board can be reduced. On the other hand, large amount of fillers in the paper or board decreases its strength.

The decrease in strength can be compensated by improving the fiber bonding properties between the fibers in the paper or board, thus maintaining the strength. The predominant treatment for improving paper or board strength has been to add a strength additive, such as starch (cationic starch), to the stock (also called furnish) prior to the sheet forming operation. Molecules of cationic starch that have been added to the stock can adhere to the naturally anionic pulp fibers by electrostatic attraction and thus be retained in the wet fiber mat and remain in the final paper or board.

By adding large amounts of cationic starch to the stock, in order to achieve high paper strength, problems occur. The cationic starch molecules tend to saturate the anionic charge on the cellulose fibers, thus setting a limit to the amount of cationic starch which can be added to the pulp slurry. If an excess of cationic starch is added, only a portion of the starch added will be retained in the sheet, and the rest will circulate in the paper or board machine white water system. Moreover, fibers which are made cationic by excessive cationic starch addition will not be able to absorb other cationic additives which are commonly added to the pulp slurry, for example sizing agents and retention aids. Large amounts of starch often cause also problems with runnability and foaming during the production process.

Addition of microfibrillated cellulose (MFC), also known as nanocellulose, to a paper or board will increase the strength of the product. This is likely due to improved fiber bonding.

Microfibrillated cellulose is a material typically made from wood cellulose fibers. It can also be made from microbial sources, agricultural fibers, dissolved cellulose or CMC etc. In microfibrillated cellulose the individual microfibrils have been partly or totally detached from each other.

WO 2011/068457 discloses a process for producing a paper or board product which contains microfibrillated cellulose. The process comprises the steps: providing a furnish comprising fibers, adding starch to the furnish, adding microfibrillated cellulose to the furnish, and conducting the furnish to a wire in order to form a web, wherein the starch and microfibrillated cellulose are added separately to the furnish. The furnish comprises starch in an amount of 2-15% by weight and microfibrillated cellulose in an amount of 1-15% by weight.

Microfibrillated cellulose has a very high water binding capacity and it is thus very difficult to reduce the water content of a slurry comprising microfibrillated cellulose. High water content of a slurry comprising microfibrillated cellulose also prevents usage of microfibrillated cellulose in many different applications where microfibrillated cellulose with high solids would be required.

Use of microfibrillated cellulose in paper and board applications will produce denser paper structure, but with worse dewatering properties. Drainage time increases as a function of microfibrillated cellulose amount.

Thus, there is a need for an improved and more efficient process for producing paper or board from microfibrillated cellulose containing stocks having improved dewatering properties.

SUMMARY OF THE INVENTION

The present invention relates to a process for the production of paper or board according to claim 1.

It has been surprisingly found that microparticles, such as bentonite and silica, proved to be really effective for improving dewatering properties of microfibrillated cellulose (MFC) containing stocks.

Usually microparticles need a cationic retention polymer in a retention system to perform, but it was surprisingly found that high amount of strength additive among the MFC is enough.

Further, it was surprisingly found that the sequence of addition of components to the stock affects the dewatering properties of MFC containing stocks. By first premixing a strength additive and MFC, then mixing the premixture with the stock followed by addition of microparticle improves the dewatering properties of MFC containing stocks significantly.

DETAILED DESCRIPTION OF THE INVENTION

The present invention provides a process for production of paper or board comprising: providing a stock comprising cellulose fibers, adding a mixture comprising microfibrillated cellulose and a strength additive to the stock, adding a microparticle to the stock after the addition of said mixture, dewatering the stock on a wire to form a web, and drying the web.

It was surprisingly found that the order of addition of components to the stock affects the dewatering properties. By first premixing MFC and a strength additive together, then adding the premixture to the stock followed by addition of a microparticle enhances the dewatering properties of the MFC containing stocks compared to a process where the components (MFC, strength additive and microparticle) are added separately or all together The premixture of MFC and the strength additive, and the microparticle are added to the stock before drainage, so that the premixture is added before the microparticle. For example, the premixture may be added 90 seconds before drainage and the microparticle 20 seconds before the drainage.

In a preferred embodiment the premixture of MFC and the strength additive is added to the thick stock flow of a paper machine, the consistency preferably being 2-6%, more preferably 3-5% by weight.

In another preferred embodiment the microparticle is added to the short circulation of a paper machine, the consistency preferably being 0.2-2.0%, more preferably 0.3-1.5% by weight.

After the additions of the premixture and the microparticle the stock is dewatered on a wire to from a web. The dewatering on the wire is performed by any method known in the art. After dewatering the formed web is dried by any method known in the art.

The stock may also comprise additional chemicals commonly used in the manufacture of paper or board.

The cellulose fibers may be hardwood and/or softwood fibers. The cellulose fibers may be mechanically, chemimechanically and/or chemically treated. The cellulose fibers may also comprise recycled fibers, such as deinked pulp. The cellulose fibers may be unbleached and/or bleached.

The term "microfibrillated cellulose", also denoted MFC, as used in this specification includes microfibrillated/microfibrillar cellulose and nano-fibrillated/nanofibrillar cellulose (NFC), which materials are also called nanocellulose.

As described above MFC is prepared from cellulose source material, usually from woodpulp. Suitable pulps that may be used for the production of MFC include all types of chemical wood-based pulps, such as bleached, half-bleached and unbleached sulphite, sulphate and soda pulps. Also dissolving pulps having a low content, typically below 5%, of hemicelluloses can be used.

The MFC fibrils are isolated from the wood-based fibers using high-pressure homogenizers. The homogenizers are used to delaminate the cell walls of the fibers and liberate the microfibrils and/or nanofibrils. Pre-treatments are sometimes used to reduce the high energy consumption. Examples of such pre-treatments are enzymatic/mechanical pre-treatment and introduction of charged groups e.g. through carboxymethylation or TEMPO-mediated oxidation. The width and length of the MFC fibers vary depending on the specific manufacturing process. The MFC can also be produced with bacteria.

A typical width of MFC is from about 3 to about 100 nm, preferably from about 10 to about 30 nm, and a typical length is from about 100 nm to about 2 μm, preferably from about 100 to about 1000 nm.

MFC is normally produced in very low solid content, usually at a consistency of between 1% and 6% by weight. However, MFCs with higher solid content can be produced by dewatering. The MFC may be also modified before addition to the stock, so that it is possible to change its interaction and affinity to other substances. For example, by introducing more anionic charges to MFC the stability of the fibril and fibril aggregates of the MFC are increased.

In a preferred embodiment the microfibrillated cellulose (MFC) is anionic.

In another preferred embodiment the microfibrillated cellulose (MFC) is added in an amount of 5-100 kg, preferably 10-80 kg, more preferably 15-70 kg and most preferably 15-50 kg on dry basis per ton of dry solids of the stock.

Drainage time of the stock on the wire increases as a function of MFC amount so it is beneficial to use strength additives to lower MFC dosage without sacrificing high strength properties.

The strength additives are chemicals that improve paper strength such as strength compression strength, bursting strength and tensile breaking strength. The strength additives act as binders of fibers and thus also increase the interconnections between the fibers.

In a preferred embodiment the strength additive comprises starch, synthetic polymer, chitosan, guar gum, carboxymethyl cellulose (CMC) or a mixture thereof.

A preferred synthetic polymer comprises polyacrylamide (C-PAM), anionic polyacrylamide (A-PAM), glyoxylated polyacrylamide (G-PAM), amphoteric polyacrylamide, polydiallyldimethylammonium chloride (poly-DADMAC), poly-acrylic amide (PAAE), polyvinyl amine (PVAm), polyethylene oxide (PEO), polyethyleneimine (PEI) or a mixture of two or more of these polymers. Preferably the synthetic polymer is C-PAM.

The average molecular weight of the synthetic polymer is in the range 100 000-20 000 000 g/mol, typically 300 000-8 000 000 g/mol, more typically 300 000-1 500 000 g/mol.

Preferably the strength additive is selected from starch, synthetic polymer or a mixture thereof, such as mixture of starch and C-PAM.

In a preferred embodiment the strength additive is added in an amount of 5-100 kg, preferably 10-80 kg, more preferably 15-70 kg and most preferably 15-50 kg on dry basis per ton of dry solids of the stock.

Microparticles can improve dewatering properties of stocks. The function of microparticle appears to involve (a) release of water from polyelectrolyte bridges, causing them to contract, and (b) acting as a link in bridges that involve macromolecules adsorbed on different fibers or fine particles. These effects create more streamlined paths for water to flow around the fibers. The tendency of microparticles to boost first-pass retention will tend to have a positive effect on initial dewatering rates.

It was surprisingly found that the microparticles are also effective for improving dewatering properties of microfibrillated cellulose (MFC) containing stocks. Usually microparticles need a cationic retention polymer in a retention system to perform, but according to the present invention high amount of strength additive among the MFC is enough.

The term "microparticle" as used in this specification includes solid, water insoluble, inorganic particles of nanosize or micro-size. A typical average particle diameter of a colloidal microparticle is from $10^{-6}$ mm to $10^{-3}$ mm.

The microparticle comprises inorganic colloidal microparticles. Preferably the inorganic colloidal microparticle comprises a silica-based microparticle, a natural silicate microparticle, a synthetic silicate microparticle, or mixtures thereof.

Typical natural silicate microparticles are e.g. bentonite, hectorite, vermiculite, baidelite, saponite and sauconite.

Typical synthetic silicate microparticles are e.g. fumed or alloyed silica, silica gel and synthetic metal silicates, such as silicates of Mg and Al type.

In a preferred embodiment the microparticle is a silica-based microparticle, a natural silicate microparticle, such as bentonite or hectorite, a synthetic silicate microparticle, or mixture thereof. More preferably the microparticle is silica-based microparticle or bentonite.

Typically the silica-based microparticle is added in an amount of 0.1-4 kg, preferably 0.2-2 kg, more preferably 0.3-1.5 kg, still more preferably 0.33-1.5 kg, even more preferably 0.33-1 kg, most preferably 0.33-0.8 kg on dry basis per ton of dry solids of the stock.

In a preferred embodiment the silica-based microparticle is added in an amount of at least 0.33 kg, preferably 0.33-4 kg, more preferably 0.33-2 kg, and most preferably 0.33-1.5 kg on dry basis per ton of dry solids of the stock Typically the natural or synthetic silicate-based microparticle is added in an amount of 0.1-10 kg, preferably 1-8 kg, more preferably 2-5 kg on dry basis per ton of dry solids of the stock.

Examples of the paper product are super calendered (SC) paper, ultralight weight coated (ULWC) paper, light weight coated (LWC) paper and newsprint paper, but the paper product is not limited to these.

Examples of the board product are liner, fluting, folding boxboard (FBB), white lined chipboard (WLC), solid bleached sulphate (SBS) board, solid unbleached sulphate (SUS) board and liquid packaging board (LPB), but the board product is not limited to these. Boards may have grammage from 120 to 500 g/m$^2$ and they may be based 100% on primary fibers, 100% recycled fibers, or to any possible blend between primary and recycled fibers.

The present invention is illustrated by the following examples, without in any way being limited thereto or thereby.

EXPERIMENTAL

Raw Materials:

Birch pulp (Schopper-Riegler number (SR) 25) and 10% precipitated calcium carbonate (PCC).

Equipment:

Dynamic Drainage Analyser (DDA), version 4.1 (beta) June 2009; Manufacturer: AB Akribi Kemikonsulter Sundsvall Sweden.

Components

Strength Additives:

Wet end potato starch (commercially available from company

Chemigate, product name Raisamyl 50021)

Fb 46 (commercially available from company Kemira, product name Fennobond 46 (cationic polyacrylamide based resin)).

MFC: MFC slurry was made from a microcrystalline cellulose (MCC)-water mixture (prepared as described in WO 2011/154601) by three passes through a Microfluidizer M-110P (Microfluidics Corporation) at an operating pressure of 2000 bar Microparticles:

Bentonite (commercially available from company Kemira, product name Altonit SF)

Silica (commercially available from company Kemira, product name

Fennosil 517)

C-PAM: cationic polyacrylamide, charge 8 mol-%, Mw about 6 000 000 g/mol.

Test Procedure

Stock is held under mixing in a DDA mixing vessel. Components are added into stock according to Table 1. The "Delay time" in Table 1 means how many seconds before the start of drainage a component is added to the stock. The drainage is conducted under 300 mPas vacuum and dewatering time measured from the beginning of drainage until air comes through the web that is formed.

TABLE 1

Components added to stock.

| Component | Delay time (s) |
|---|---|
| Strength additives: | −150 |
| Wet end potato starch | |
| Fb 46 | |
| MFC | −90 |
| Microparticles: | −20 |
| Bentonite | |
| Silica | |
| C-PAM | −10 |
| Drainage | 0 |

Reference Example 1

Effect of Strength Additive and MFC on Dewatering

The used components are added separately according to Table 1. Reference Example 1 is performed according to the above described Test procedure. The components and amounts of the components are disclosed in Table 2. The amount of a component is in brackets, and is disclosed as kg on dry basis per ton of dry solids of the stock.

TABLE 2

Effect of strength additive and MFC on dewatering.

| Test No | Component (as dry basis kg/t) | Dewatering time (s) |
|---|---|---|
| 1 | 0-test | 2.46 |
| 2 | Wet end potato starch (10) | 3.10 |
| 3 | Wet end potato starch (20) | 3.22 |
| 3' | Fb 46 (1.5) | 5.44 |
| 3" | Fb 46 (3) | 4.84 |
| 4 | MFC (50) | 9.44 |
| 5 | MFC (100) | 30.00 |
| 6 | Wet end potato starch (10) + MFC (25) | 8.12 |
| 7 | Wet end potato starch (10) + MFC (50) | 12.25 |
| 8 | Wet end potato starch (20) + MFC (12.5) | 5.87 |
| 9 | Wet end potato starch (20) + MFC (25) | 9.95 |
| 9' | Fb 46 (3) + MFC (15) | 6.80 |
| 9" | Fb 46 (3) + MFC (25) | 8.22 |

As can be seen from Table 2, strength additive alone does not affect significantly on drainage properties. MFC deteriorates heavily dewatering properties.

Reference Example 2

Effect of Strength Additive, MFC and Retention Chemical (C-PAM) on Dewatering

The used components are added separately according to Table 1. Reference Example 2 is performed according to the above described Test procedure. The components and amounts of the components are disclosed in Table 3. The amount of a component is in brackets, and is disclosed as kg on dry basis per ton of dry solids of the stock.

TABLE 3

Effect of strength additive, MFC and retention chemical (C-PAM) on dewatering.

| Test No | Component (as dry basis kg/t) | Dewatering time (s) |
|---|---|---|
| 9 | Wet end potato starch (20) + MFC (25) | 9.95 |
| 10 | Wet end potato starch (20) + MFC (25) + C-PAM (0.2) | 6.12 |
| 11 | Wet end potato starch (20) + MFC (25) + C-PAM (0.4) | 7.13 |
| 12 | Wet end potato starch (20) + MFC (25) + C-PAM (0.8) | 7.49 |

As can be seen from Table 3, C-PAM improves slightly dewatering properties.

Reference Example 3

Effect of Strength Additive, MFC and Microparticle (Bentonite) on Dewatering

The used components are added separately according to Table 1. Reference

Example 3 is performed according to the above described Test procedure. The components and amounts of the components are disclosed in Table 4. The amount of a component is in brackets, and is disclosed as kg on dry basis per ton of dry solids of the stock.

TABLE 4

Effect of strength additive, MFC and microparticle (bentonite) on dewatering.

| Test No | Component (as dry basis kg/t) | Dewatering time (s) |
|---|---|---|
| 9 | Wet end potato starch (20) + MFC (25) | 9.95 |
| 13 | Wet end potato starch (20) + MFC (25) + Bentonite (2) | 5.58 |
| 14 | Wet end potato starch (20) + MFC (25) + Bentonite (4) | 6.25 |
| 15 | Wet end potato starch (20) + MFC (25) + Bentonite (8) | 4.34 |

As can be seen from Table 4, bentonite is better than C-PAM.

Reference Example 4

Effect of Strength Additive, MFC and Microparticle (Silica) on Dewatering

The used components are added separately according to Table 1. Reference Example 4 is performed according to the above described Test procedure. The components and amounts of the components are disclosed in Table 5. The amount of a component is in brackets, and is disclosed as kg on dry basis per ton of dry solids of the stock.

TABLE 5

Effect of strength additive, MFC and microparticle (silica) on dewatering.

| Test No | Component (as dry basis kg/t) | Dewatering time (s) |
|---|---|---|
| 9 | Wet end potato starch (20) + MFC (25) | 9.95 |
| 16 | Wet end potato starch (20) + MFC (25) + Silica (0.34) | 8.34 |
| 17 | Wet end potato starch (20) + MFC (25) + Silica (0.68) | 7.25 |
| 18 | Wet end potato starch (20) + MFC (25) + Silica (1.36) | 6.25 |

As can be seen from Table 5, silica is not as good as bentonite at high dosage, but is slightly better than C-PAM.

Reference Example 5

Effect of Premixing all Components before Mixing with the Stock

All the components are premixed together before adding the premixture into stock. The premixture is added at the delay time of 90 s. The DDA mixing vessel and conditions are as described in the above Test procedure. The components and amounts of the components are disclosed in Table 6. The amount of a component is in brackets, and is disclosed as kg on dry basis per ton of dry solids of the stock.

TABLE 6

Effect of premixing all components before mixing with the stock.

| Test No | Component (as dry basis kg/t) | Dewatering time (s) |
|---|---|---|
| 19 | 0-test | 4.33 |
| 20 | Wet end potato starch (20) + MFC (25) | 10.18 |

TABLE 6-continued

Effect of premixing all components before mixing with the stock.

| Test No | Component (as dry basis kg/t) | Dewatering time (s) |
|---|---|---|
| 21 | Wet end potato starch (20) + MFC (25) + C-PAM(0.2) | 9.74 |
| 22 | Wet end potato starch (20) + MFC (25) + C-PAM(0.8) | 10.03 |
| 23 | Wet end potato starch (20) + MFC (25) + Silica (0.34) | 10.32 |
| 24 | Wet end potato starch (20) + MFC (25) + Silica (1.36) | 8.6 |
| 25 | Wet end potato starch (20) + MFC (25) + Bentonite (2) | 10.21 |
| 26 | Wet end potato starch (20) + MFC (25) + Bentonite (8) | 9.36 |

As can be seen from Table 6, premixing all the components before mixing the premixture with the stock didn't improve dewatering but opposite. Dewatering times are at the same level as without bentonite or silica addition or C-PAM.

Example 1

Effect of Premixing Strength Additive and MFC before Mixing the Premixture with the Stock followed by Addition of Bentonite, Silica or C-PAM Strength additive and MFC are premixed and added into the stock at the delay time 90 s after which silica or bentonite or C-PAM is added separately at the delay time 20 s. The DDA mixing vessel and conditions are as described in the above Test procedure. The components and amounts of the components are disclosed in Table 7. The amount of a component is in brackets, and is disclosed as kg on dry basis per ton of dry solids of the stock.

TABLE 7

Effect of premixing strength additive and MFC before mixing the premixture with the stock followed by addition of bentonite or silica or C-PAM.

| Test No | Component (as dry basis kg/t) | Dewatering time (s) |
|---|---|---|
| 19 | 0-test | 4.33 |
| 20 | Wet end potato starch (20) + MFC (25) | 10.18 |
| 27 | Wet end potato starch (20) + MFC (25) + C-PAM(0.2) | 7.77 |
| 28 | Wet end potato starch (20) + MFC (25) + C-PAM(0.8) | 5.98 |
| 29 | Wet end potato starch (20) + MFC (25) + Silica (0.34) | 5.23 |
| 30 | Wet end potato starch (20) + MFC (25) + Silica (1.36) | 2.86 |
| 31 | Wet end potato starch (20) + MFC (25) + Bentonite (2) | 5.46 |
| 32 | Wet end potato starch (20) + MFC (25) + Bentonite (8) | 2.99 |
| 32' | Fb 46 (3) + MFC (25) + Silica (1.36) | 4.21 |
| 32'' | Fb 46 (3) + MFC (25) + Bentonite (2) | 3.51 |
| 32''' | Fb 46 (3) + MFC (25) + Bentonite (8) | 3.04 |

Tests No. 29-32 and 32'-32''' represent the present invention. As can be seen from Table 7, significant improvement on dewatering time can be observed by first premixing strength additive and MFC, mixing the premixture with the stock followed by addition of microparticle. Use of silica or bentonite results in improved dewatering time compared to use of C-PAM.

The invention claimed is:

1. A process for production of paper or board comprising the steps of:

a) providing a stock comprising cellulose fibers, b) preparing a premixture of microfibrillated cellulose (MFC) and a strength additive, wherein the strength additive comprises starch and at least one synthetic polymer selected from the group consisting of cationic polyacrylamide (C-PAM), anionic polyacrylamide (A-PAM), glyoxylated polyacrylamide (G-PAM), amphoteric polyacrylamide, polydiallyldimethylammonium chloride (poly-DADMAC), polyacrylic amide (PAAE), polyvinyl amine (PVAm), polyethylene oxide (PEO), and polyethyleneimine (PEI);

c) adding the premixture into the stock, d) adding a microparticle selected from silica-based microparticle, a natural silicate microparticle, a synthetic silcate microparticle or a mixture thereof to the mixture of step c, e) dewatering the mixture of step d) on a wire to form a web, and f) drying the web.

2. The process of claim 1 wherein the strength additive comprises chitosan, guar gum, carboxymethyl cellulose (CMC) or a mixture thereof.

3. The process of claim 1 wherein an average molecular weight of the synthetic polymer is in range of 100 000-20 000 000 g/mol.

4. The process of claim 3, wherein the average molecular weight of the synthetic polymer is in typically 300 000-8 000 000 g/mol.

5. The process of claim 4, wherein the average molecular weight of the synthetic polymer is 300 000-1 500 000 g/mol.

6. The process of claim 1 wherein said microparticle is added to a short circulation of a paper machine, the consistency preferably being 0.2-2.0%, by weight.

7. The process of claim 1 wherein the microparticle is a silica-based microparticle and it is added in an amount of 0.1-4 kg on dry basis per ton of dry solids of the stock.

8. The process of claim 7 wherein the microparticle is added in an amount of 0.33-0.8 kg on dry basis per ton of dry solids of the stock.

9. The process of claim 1 wherein the microparticle is a natural or a synthetic silicate microparticle and is added in an amount of 0.1-10 kg on dry basis per ton of dry solids of the stock.

10. The process of claim 9, wherein the microparticle is bentonite or hectorite.

11. The process of claim 9 wherein the microparticle is added in an amount of 2-5 kg on dry basis per ton of dry solids of the stock.

12. The process of claim 1 wherein the microfibrillated cellulose is added in an amount of 5-100 kg on dry basis per ton of dry solids of the stock.

13. The process of claim 12 wherein the microfibrillated cellulose is added in an amount of 15-50 kg on dry basis per ton of dry solids of the stock.

14. The process of claim 1 wherein the strength additive is added in an amount of 5-100 kg on dry basis per ton of dry solids of the stock.

15. The process of claim 14 wherein the strength additive is added in an amount of 15-50 kg on dry basis per ton of dry solids of the stock.

16. The process of claim 1 wherein said premixture is added to a thick stock flow of a paper machine, the consistency being 2-6% by weight.

17. The process of claim 16, wherein said premixture is added to a thick stock flow of a paper machine, the consistency 3-5% by weight.

18. The process of claim 6 wherein the microparticle is added to a short circulation of a paper machine, the consistency being 0.31.5% by weight.

19. The process of claim 1 wherein the microfibrillated cellulose is anionic.

* * * * *